US010446919B2

(12) United States Patent
Shiozaki et al.

(10) Patent No.: US 10,446,919 B2
(45) Date of Patent: Oct. 15, 2019

(54) ANTENNA DEVICE

(71) Applicant: Panasonic Intellectual Property Management Co., Ltd., Osaka (JP)

(72) Inventors: Ryosuke Shiozaki, Tokyo (JP); Yuichi Kashino, Ishikawa (JP); Ken Takahashi, Ishikawa (JP); Yuto Suzuki, Miyagi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/634,287

(22) Filed: Jun. 27, 2017

(65) Prior Publication Data

US 2018/0013194 A1 Jan. 11, 2018

(30) Foreign Application Priority Data

Jul. 5, 2016 (JP) ..... 2016-133471

(51) Int. Cl.
*H01Q 1/42* (2006.01)
*H01Q 1/32* (2006.01)
(Continued)

(52) U.S. Cl.
CPC ..... *H01Q 1/3233* (2013.01); *H01Q 1/005* (2013.01); *H01Q 1/421* (2013.01); *H01Q 15/14* (2013.01); *H01Q 21/065* (2013.01); *H01Q 1/528* (2013.01)

(58) Field of Classification Search
CPC ..... H01Q 1/38; H01Q 1/42
(Continued)

(56) References Cited

U.S. PATENT DOCUMENTS

2005/0001757 A1 1/2005 Shinoda et al.
2006/0092079 A1* 5/2006 de Rochemont ..... H01Q 1/362 343/700 MS (Continued)

FOREIGN PATENT DOCUMENTS

JP 2003-240838 A 8/2003
NL 1025003 C2 8/2005

OTHER PUBLICATIONS

Extended European Search Report, dated Oct. 19, 2017 for the related European Patent Application No. 17177339.3-1927, 9 pages.

(Continued)

*Primary Examiner* — Dameon E Levi
*Assistant Examiner* — Hasan Z Islam
(74) *Attorney, Agent, or Firm* — Seed IP Law Group LLP

(57) ABSTRACT

An antenna device comprising: one or more substrates; a first radiating element disposed on a first region of a surface of the one or more substrates that face a cover covering the antenna device; a second radiating element disposed on a second region of the surface of the one or more substrates that face the cover; a first reflecting plate that reflects an electromagnetic wave from the first radiating element; and a second reflecting plate that reflects an electromagnetic wave from the second radiating element, wherein the first reflecting plate and the second reflecting plate take different positions in a direction perpendicular to the surface of the one or more substrates that face the cover, and the first region and the second region are regions that do not overlap each other on the surface of the one or more substrates that face the cover.

2 Claims, 10 Drawing Sheets

(51) Int. Cl.

| | |
|---|---|
| ***H01Q 1/00*** | (2006.01) |
| ***H01Q 15/14*** | (2006.01) |
| ***H01Q 21/06*** | (2006.01) |
| *H01Q 1/52* | (2006.01) |

(58) Field of Classification Search
USPC ..... 343/700 MS, 893
See application file for complete search history.

(56) References Cited

U.S. PATENT DOCUMENTS

2007/0273607 A1 11/2007 Chen
2010/0066631 A1* 3/2010 Puzella ..... H01Q 1/02 343/853
2011/0095947 A1* 4/2011 Chou ..... H01Q 9/0421 343/700 MS
2013/0063316 A1* 3/2013 Moiraghi ..... H01Q 1/3233 343/713
2014/0197996 A1* 7/2014 Yonei ..... H01Q 9/0421 343/700 MS

OTHER PUBLICATIONS

Communication pursuant to Article 94(3) EPC, dated Sep. 26, 2018, for the related European Patent Appliction No. 17177339.3, 7 pages.
Communication pursuant to Article 94(3) EPC dated Mar. 18, 2019 for the related European Patent Application No. 17177339.3.
Ieee: "IEEE Standard for Definitions of Terms for Antennas", IEEE Standard, Mar. 11, 2014 (Mar. 11, 2014), pp. 1-50, XP055566169, Piscataway, NJ, USA DOI:10.1109/MAP.2014.6867714 ISBN:978-0-7381-8927-7 Retrieved from the Internet: URL:https://ieeexplore.ieee.org/stampPDF/getPDF.jsp?tp=&arnumber=6758443 [retrieved on Mar. 7, 2019].

* cited by examiner

ANTENNA DEVICE

BACKGROUND

1. Technical Field

The present disclosure relates to an antenna device.

2. Description of the Related Art

Conventionally, on-vehicle radar apparatuses have been known as radar apparatuses that detect obstacles by transmitting and receiving electromagnetic waves. An on-vehicle radar apparatus is used, for example, for detecting an obstacle while the vehicle is moving and for detecting a vehicle that is passing from behind. In a case where such a radar apparatus is attached to a vehicle, it is often installed in a bumper of the vehicle. However, in a case where the radar apparatus is installed in the bumper of the vehicle, the radar apparatus deteriorates in detection performance, as the bumper reflects an electromagnetic wave.

As a method for preventing the radar apparatus from deteriorating in detection performance due to a cover member of the bumper, Japanese Unexamined Patent Application Publication No. 2003-240838, for example, discloses a technology for optimizing the thickness of the cover member.

However, even with the optimization of the thickness of the cover member, the radar apparatus deteriorates in detection performance, for example, due to the difference in the reflectance of an electromagnetic wave attributed to the fact that coating agents that are applied to the outer sides of cover members vary from one type of vehicle to another and due to the difference in the reflectance of an electromagnetic wave attributed to the fact that individual cover members vary in thickness.

Further, an electromagnetic wave reflected by the cover member undergoes multiple reflections between the cover member and an antenna device of the radar apparatus. The state of the multiple reflections depends on the distance between the cover member and the antenna device.

The distance between the cover member and the antenna device changes according to variations in installation operation at the time of installation of the radar apparatus. Furthermore, in the case of a vehicle, the distance between the cover member and the antenna device also changes according to vibrations while the vehicle is moving. For this reason, changes in the distance between the cover member and the antenna device as caused by these factors cause variations in detection performance of the radar apparatus.

SUMMARY

One non-limiting and exemplary embodiment provides an antenna device that contributes to reducing the occurrence of multiple reflections of an electromagnetic wave between a cover member and an antenna device and thus reducing variations in detection performance of a radar apparatus.

In one general aspect, the techniques disclosed here feature an antenna device comprising: one or more substrates; a first radiating element disposed on a first region of a surface of the one or more substrates that face a cover covering the antenna device; a second radiating element disposed on a second region of the surface of the one or more substrates that face the cover; a first reflecting plate that reflects an electromagnetic wave from the first radiating element; and a second reflecting plate that reflects an electromagnetic wave from the second radiating element, wherein the first reflecting plate and the second reflecting plate take different positions in a direction perpendicular to the surface of the one or more substrates that face the cover, and the first region and the second region are regions that do not overlap each other on the surface of the one or more substrates that face the cover.

The present disclosure makes it possible to reduce the occurrence of multiple reflections of an electromagnetic wave between a cover member and an antenna device and thus reduce variations in detection performance of a radar apparatus.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
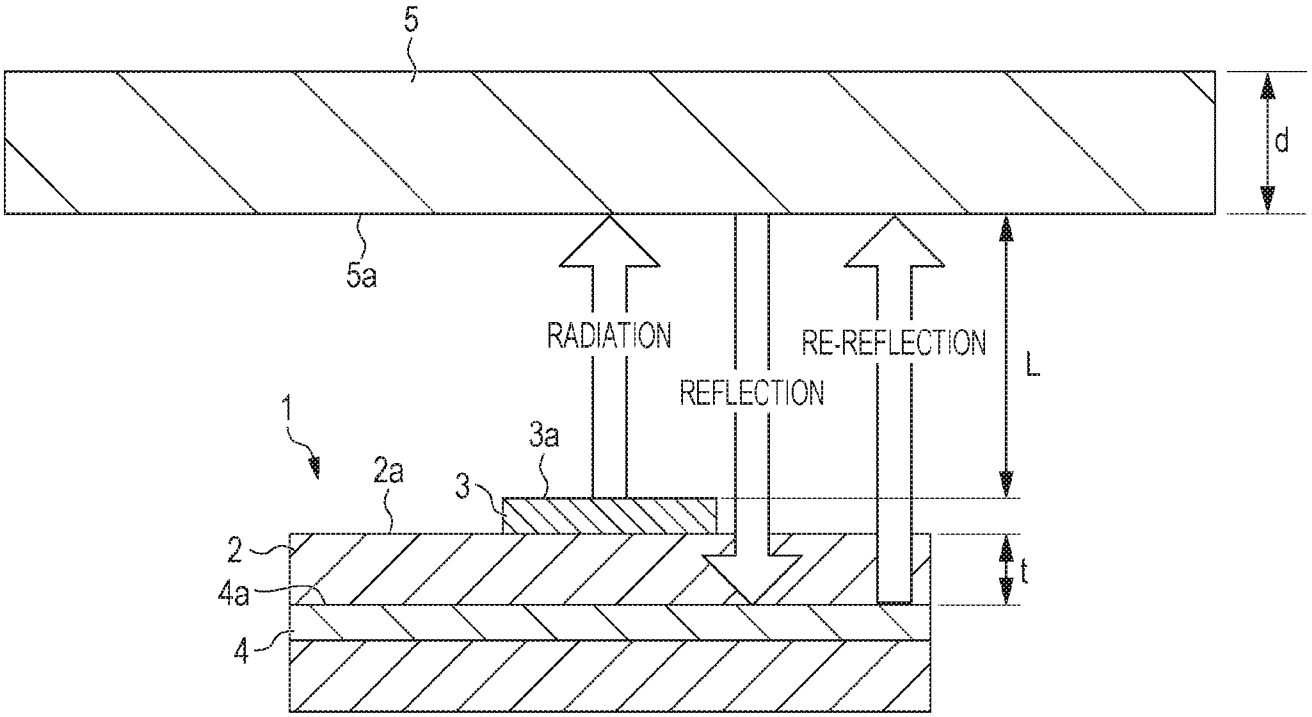
FIG. 1 is a diagram showing a positional relationship between a cover member and an antenna device.

Embodiments of the present disclosure are described below with reference to the drawings. Descriptions are given by taking, as a particular example, an on-vehicle radar apparatus that is installed on a vehicle. Throughout the embodiments, identical components are given identical reference numerals and repeated descriptions are omitted. All of the drawings shown below schematically show configurations, show the dimensions of each element in an exaggerated way for ease of explanation, and omit to illustrate elements as needed.

First, the behavior of an electromagnetic wave that is generated between an antenna device 1 and a cover member 5 is described with reference to FIG. 1. FIG. 1 is a diagram showing a positional relationship between the antenna device 1 and the cover member 5. The antenna device 1 includes a substrate 2, an antenna element 3, and a reflecting plate 4. The substrate 2 has two surfaces one of which is a surface 2*a* that faces the cover member 5. The antenna element 3 is disposed on the surface 2*a*. The reflecting plate 4 is disposed within the substrate 2. The reflecting plate 4 serves to enhance the directivity of an antenna in a predetermined direction. The reflecting plate 4 has a wider area than the antenna element 3 does.

In a case where the antenna element 3 is a transmitting antenna, an electromagnetic wave is radiated from a surface 3*a* of the antenna element 3 that faces the cover member 5 toward the cover member 5. The electromagnetic wave thus radiated propagates through space between the antenna device 1 and the cover member 5 and arrives at a surface 5*a* of the cover member 5 that faces the antenna device 1.

A portion of the electromagnetic wave that has arrived at the surface 5*a* of the cover member 5 travels through the cover member 5, and another portion of the electromagnetic wave that has arrived at the surface 5*a* of the cover member 5 does not travel through the cover member 5 but is reflected toward the antenna device 1. The electromagnetic wave reflected by the surface 5*a* of the cover member 5 arrives at a surface 4*a* of the reflecting plate 4 of the antenna device 1 that faces the cover member 5. The electromagnetic wave having arrived at the surface 4*a* of the reflecting plate 4 is re-reflected toward the cover member 5.

Since electromagnetic waves are continuously radiated from the antenna element 3, the electromagnetic wave re-reflected by the reflecting plate 4 is superposed on an electromagnetic wave radiated from the antenna element 3.

An electromagnetic wave (hereinafter referred to as "superposed electromagnetic wave") obtained by superposing the electromagnetic wave re-reflected by the reflecting plate 4 on an electromagnetic wave that is radiated from the antenna element 3 is strengthened or weakened by the phase difference between the electromagnetic wave that is radiated from the antenna element 3 and the electromagnetic wave re-reflected by the reflecting plate 4. For this reason, the substantial level of an electromagnetic wave of antenna radiation is captured as becoming higher and becoming lower. This phenomenon causes changes in intensity level of an electromagnetic wave that is radiated from the antenna device 1.

A case is described here where an electromagnetic wave reflected by the cover member 5 is re-reflected by the reflecting plate 4 and superposed on an electromagnetic wave radiated from the antenna element 3.

First, an electromagnetic wave that is reflected by the cover member 5 is expressed by formula (1):

$$\frac{j\left(\sqrt{\varepsilon c}-\frac{1}{\sqrt{\varepsilon c}}\right)\sin\beta d}{2\cos\beta d+j\left(\sqrt{\varepsilon c}+\frac{1}{\sqrt{\varepsilon c}}\right)\sin\beta d} \tag{1}$$

where εc is the relative dielectric constant of the cover member 5, d is the thickness of the cover member 5, and ε0 is the dielectric constant of the space outside the cover member 5.

In formula (1), β is expressed as $$\beta=\frac{2\pi}{\lambda e},$$

where λe is the wavelength of the electromagnetic wave inside the cover member 5.

Further, λe is expressed as $$\lambda e=\frac{\lambda}{\sqrt{\varepsilon c}},$$

where λ is the wavelength of the electromagnetic wave in the space outside the cover member 5.

Therefore, in formula (1), βd can be expressed as $$\beta d=2\pi d\frac{\sqrt{\varepsilon c}}{\lambda}.$$

Note here that in a case where the phase of an electromagnetic wave that is radiated from the antenna element 3 is 0 and the distance between the surface 3*a* of the antenna element 3 and the surface 5*a* of the cover member 5 is 1, formula (1) can be expressed by formula (2):

$$\frac{j\left(\sqrt{\varepsilon c}-\frac{1}{\sqrt{\varepsilon c}}\right)\sin\beta d}{2\cos\beta d+j\left(\sqrt{\varepsilon c}+\frac{1}{\sqrt{\varepsilon c}}\right)\sin\beta d}\times e^{j\frac{2\pi l}{\lambda}} \tag{2}$$

Note here that, as mentioned above, the electromagnetic wave reflected by the cover member 5 arrives at the reflecting plate 4 and is re-reflected toward the cover member 5. It should be noted that such re-reflections may occur both on the surface 2*a* of the substrate 2 that faces the cover member 5 and on the reflecting plate 4. However, the thickness of the substrate 2 is sufficiently small with respect to λ. Therefore, the effect on the superposed electromagnetic wave of an electromagnetic wave re-reflected by the surface 2*a* of the substrate 2 is sufficiently smaller than the effect on the superposed electromagnetic wave of the electromagnetic wave re-reflected by the reflecting plate 4. Given this situation, the re-reflection on the reflecting plate 4 is considered here.

In a case where the phase of the electromagnetic wave that is radiated from the antenna element 3 is 0, an electromagnetic wave arriving at the surface 4*a* of the reflecting plate 4 is expressed by formula (3):

$$\frac{j\left(\sqrt{\varepsilon c}-\frac{1}{\sqrt{\varepsilon c}}\right)\sin d\frac{\sqrt{\varepsilon c}}{\lambda}}{2\cos d\frac{\sqrt{\varepsilon c}}{\lambda}+j\left(\sqrt{\varepsilon c}+\frac{1}{\sqrt{\varepsilon c}}\right)\sin d\frac{\sqrt{\varepsilon c}}{\lambda}}\times e^{j\frac{2\pi}{\lambda}(2l+t\sqrt{\varepsilon b})} \tag{3}$$

where t is the distance between the surface 2*a* of the substrate 2 and the surface 4*a* of the reflecting plate 4 and εb is the relative dielectric constant of the substrate 2.

Further, since the reflecting plate 4 is considered to be sufficiently low in impedance as in the case of a short-circuited end, the re-reflection on the reflecting plate 4 is a reversed-phase total reflection.

Furthermore, the electromagnetic wave re-reflected by the reflecting plate 4 travels the distance t by the time it is superposed on the electromagnetic wave that is radiated from the antenna element 3. Therefore, on the surface 3*a* of the antenna element 3, the re-reflected electromagnetic wave that is superposed on the electromagnetic wave that is radiated from the antenna element 3 is expressed by formula (4):

$$\frac{j\left(\sqrt{\varepsilon c}-\frac{1}{\sqrt{\varepsilon c}}\right)\sin d\frac{\sqrt{\varepsilon c}}{\lambda}}{2\cos d\frac{\sqrt{\varepsilon c}}{\lambda}+j\left(\sqrt{\varepsilon c}+\frac{1}{\sqrt{\varepsilon c}}\right)\sin d\frac{\sqrt{\varepsilon c}}{\lambda}}\times e^{j\frac{4\pi}{\lambda}(l+t\sqrt{\varepsilon b})} \tag{4}$$

In a case where the electromagnetic wave that is radiated from the antenna element 3 has a power of 1 and a phase of 0, the superposed electromagnetic wave obtained by superposing the electromagnetic wave re-reflected by the reflating plate 4 on the electromagnetic wave that is radiated from the antenna element 3 is expressed by formula (5):

$$1-\frac{j\left(\sqrt{\varepsilon c}-\frac{1}{\sqrt{\varepsilon c}}\right)\sin d\frac{\sqrt{\varepsilon c}}{\lambda}}{2\cos d\frac{\sqrt{\varepsilon c}}{\lambda}+j\left(\sqrt{\varepsilon c}+\frac{1}{\sqrt{\varepsilon c}}\right)\sin d\frac{\sqrt{\varepsilon c}}{\lambda}}\times e^{j\frac{4\pi}{\lambda}(l+t\sqrt{\varepsilon b})} \tag{5}$$

Figure 2:
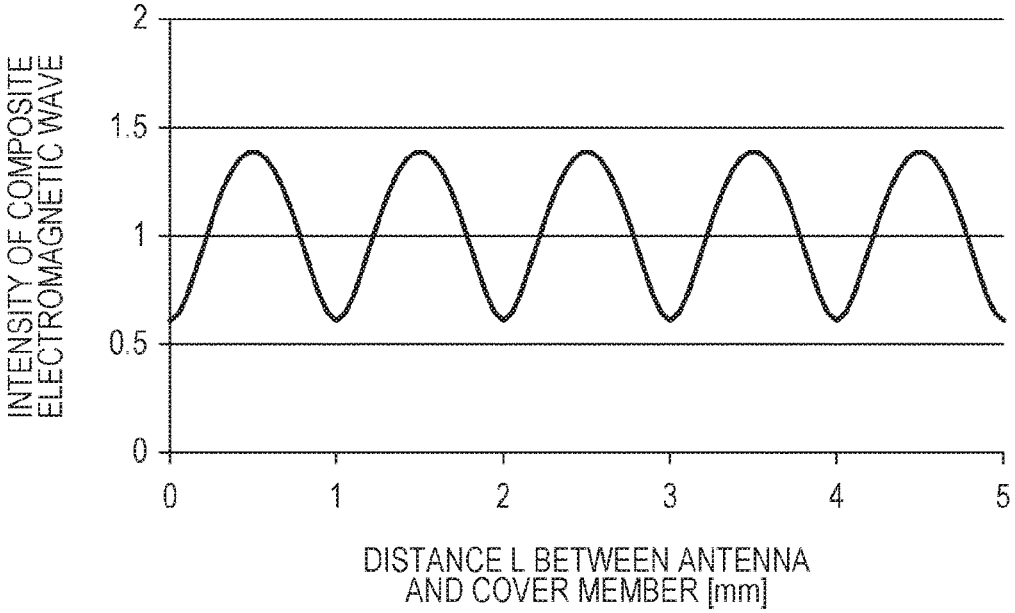
FIG. 2 is a diagram showing changes in intensity of an electromagnetic wave in the case of changes in the distance between the cover member and the antenna device.

Note here that FIG. 2 shows a diagram expressing the intensity of a superposed electromagnetic wave in the case of changes in the distance L (mm) between the surface 3*a* of the antenna element 3 and the surface 5*a* of the cover member 5, assuming that εc=3, εb=4, d=3 (mm), and t=0.2 (mm). In FIG. 2, the vertical axis represents the intensity of the superposed electromagnetic wave and the horizontal axis represents the distance L (mm) between the surface 3*a* of the antenna element 3 and the surface 5*a* of the cover member 5.

As shown in FIG. 2, the superposed electromagnetic wave changes in intensity according to the distance L. This is because the phase difference between the electromagnetic wave that is radiated from the antenna element 3 and the electromagnetic wave re-reflected from the reflecting plate 4 changes according to the distance L.

Therefore, in a case where the antenna device 1 is installed on a vehicle, the radiant intensity of an electromagnetic wave from the antenna device 1 fluctuates even with optimization of the distance L, as the distance L changes according to variations in installation operation at the time of installation of the antenna device 1 and also changes according to vibrations while the vehicle is moving.

First Embodiment

Figure 3:
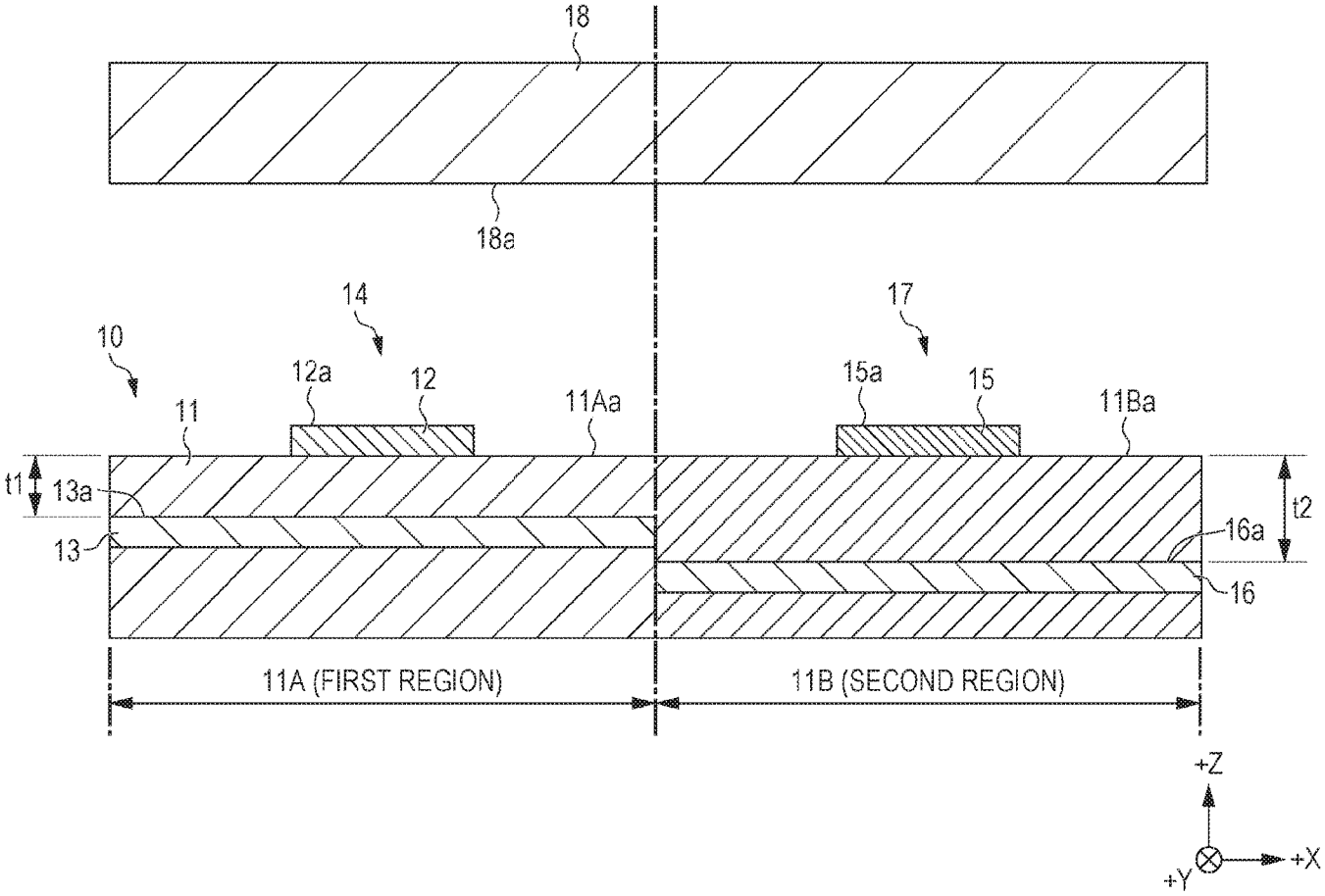
FIG. 3 is a cross-sectional view showing an antenna device according to a first embodiment.

FIG. 3 is a diagram showing a positional relationship between an antenna device 10 according to a first embodiment and a cover member 18. It should be noted that the following description assumes that, in FIG. 3, the horizontal direction is an X direction, the rightward direction is a +X direction, and the leftward direction is a −X direction. Further, the following description assumes that, in FIG. 3, the direction normal to the surface of paper is a Y direction, the direction toward the back of the surface of paper is a +Y direction, and the direction toward the front of the surface of paper is a −Y direction. Further, the following description assumes that, in FIG. 3, the vertical direction is a Z direction, the upward direction is a +Z direction, and the downward direction is a −Z direction.

The antenna device 10 includes a substrate 11, a first antenna 14, and a second antenna 17. The first antenna 14 includes a first region 11A of the substrate 11, a first antenna element 12, and a first reflecting plate 13. The second antenna 17 includes a second region 11B of the substrate 11, a second antenna element 15, and a second reflecting plate 16. It should be noted that the first region 11A and the second region 11B are separate regions that are defined so as not to overlap each other in an X-axis direction that is perpendicular to the thickness direction of the substrate 11. Further, the substrate 11 may be constituted by one or more substrates. For example, in a case where the substrate 11 is constituted by two substrates, one of the two substrates is provided in correspondence with the first region 11A and the other substrate is provided in correspondence with the second region 11B.

The substrate 11 is a flat-plate member, made of an electrical insulating base material, which extends in the X and Y directions. Usable examples of the electrical insulating base material that constitutes the substrate 11 include materials that are good in high-frequency characteristics, such as a PPE base material made of polyphenylene ether (PPE) resin, a PTFE base material made of polytetrafluoroethylene (PTFE) resin, a liquid crystal polymer (LCP), and polyimide (PI).

Other usable examples of the electrical insulating base material that constitutes the substrate 11 include a glass epoxy base material, a thermosetting resin, and a composite material containing a thermoplastic resin and an inorganic filler. An example of the thermosetting resin is epoxy resin. A usable example of the organic filler that is added may be an $Al_2O_3$, $SiO_2$, MgO, or AlN filler.

The first antenna element 12 of the first antenna 14 is a flat-plate member, made for example of a metallic conductor, which extends in the X and Y directions. The first antenna element 12 is disposed on a surface 11Aa of the first region 11A of the substrate 11 that faces the cover member 18. The first antenna element 12 has a surface 12*a* that faces the cover member 18. The first antenna element 12 radiates an electromagnetic wave toward the cover member 18.

The first reflecting plate 13 of the first antenna 14 is a flat-plate member, made for example of a metallic conductor, which extends in the X and Y directions.

The first reflecting plate 13 is disposed within the substrate 11. That is, the first reflecting plate 13 is disposed on the side opposite to the cover member 18 across the first antenna element 12 in the first region 11A. The first reflecting plate 13 has a surface 13*a* that faces the cover member 18. The first reflecting plate 13 has a wider area in an X-Y plane than the first antenna element 12 does.

A portion of the electromagnetic wave radiated from the first antenna element 12 toward the cover member 18 is reflected by the cover member 18, and the first reflecting plate 13 re-reflects this reflected electromagnetic wave toward the cover member 18.

The second antenna element 15 of the second antenna 17 is a flat-plate member, made for example of a metallic conductor, which extends in the X and Y directions. The second antenna element 15 is identical in shape to the first antenna element 12, and the second antenna element 15 is equal in thickness to the first antenna element 12.

The second antenna element 15 is disposed on a surface 11Ba of the second region 11B of the substrate 11 that faces the cover member 18. The second antenna element 15 has a surface 15*a* that faces the cover member 18. The second antenna element 15 radiates an electromagnetic wave toward the cover member 18.

The second reflecting plate 16 of the second antenna 17 is a flat-plate member, made for example of a metallic conductor, which extends in the X and Y directions. The second reflecting plate 16 is identical in shape to the first reflecting plate 13.

The second reflecting plate 16 is disposed within the substrate 11. That is, the second reflecting plate 16 is disposed on the side opposite to the cover member 18 across the second antenna element 15 in the second region 11B. The second reflecting plate 16 has a surface 16*a* that faces the cover member 18. The second reflecting plate 16 has a wider area in the X-Y plane than the second antenna element 15 does.

A portion of the electromagnetic wave radiated from the second antenna element 15 toward the cover member 18 is reflected by the cover member 18, and the second reflecting plate 16 re-reflects this reflected electromagnetic wave toward the cover member 18.

In the antenna device 10, the first antenna element 12 and the second antenna element 15 are disposed in the same plane. Therefore, the distance from the surface 12*a* of the first antenna element 12 to a surface 18*a* of the cover member 18 and the distance from the surface 15*a* of the second antenna element 15 to the surface 18*a* of the cover member 18 are equal.

Further, in the antenna device 10, the first reflecting plate 13 and the second reflecting plate 16 are disposed to take different positions in the Z direction. Therefore, the distance from the surface 12*a* of the first antenna element 12 to the surface 13*a* of the first reflecting plate 13 and the distance from the surface 15*a* of the second antenna element 15 to the surface 16*a* of the second reflecting plate 16 are different. Further, the distance from the surface 13*a* of the first reflecting plate 13 to the surface 18*a* of the cover member 18 and the distance from the surface 16*a* of the second reflecting plate 16 to the surface 18*a* of the cover member 18 are different.

The following describes the effects of the antenna device 10 in which the first reflecting plate 13 and the second reflecting plate 16 are disposed to take different positions in the Z direction.

A superposed electromagnetic wave from the first antenna 14 obtained by superposing, on an electromagnetic wave that is radiated from the first antenna element 12, an electromagnetic wave that is re-reflected by the first reflecting plate 13 is expressed by formula (6):

$$1-\frac{j\left(\sqrt{\varepsilon c}-\frac{1}{\sqrt{\varepsilon c}}\right)\sin d\frac{\sqrt{\varepsilon c}}{\lambda}}{2\cos d\frac{\sqrt{\varepsilon c}}{\lambda}+j\left(\sqrt{\varepsilon c}+\frac{1}{\sqrt{\varepsilon c}}\right)\sin d\frac{\sqrt{\varepsilon c}}{\lambda}}\times e^{j\frac{4\pi}{\lambda}(l+t1\sqrt{\varepsilon b})} \tag{6}$$

where t1 is the distance from the surface 12*a* of the first antenna element 12 to the surface 13*a* of the first reflecting plate 13.

Meanwhile, a superposed electromagnetic wave from the second antenna 17 obtained by superposing, on an electromagnetic wave that is radiated from the second antenna element 15, an electromagnetic wave that is re-reflected by the second reflecting plate 16 is expressed by formula (7):

$$1-\frac{j\left(\sqrt{\varepsilon c}-\frac{1}{\sqrt{\varepsilon c}}\right)\sin d\frac{\sqrt{\varepsilon c}}{\lambda}}{2\cos d\frac{\sqrt{\varepsilon c}}{\lambda}+j\left(\sqrt{\varepsilon c}+\frac{1}{\sqrt{\varepsilon c}}\right)\sin d\frac{\sqrt{\varepsilon c}}{\lambda}}\times e^{j\frac{4\pi}{\lambda}(l+t2\sqrt{\varepsilon b})} \tag{7}$$

where t2 is the distance from the surface 15*a* of the second antenna element 15 to the surface 16*a* of the second reflecting plate 16.

Figure 4:
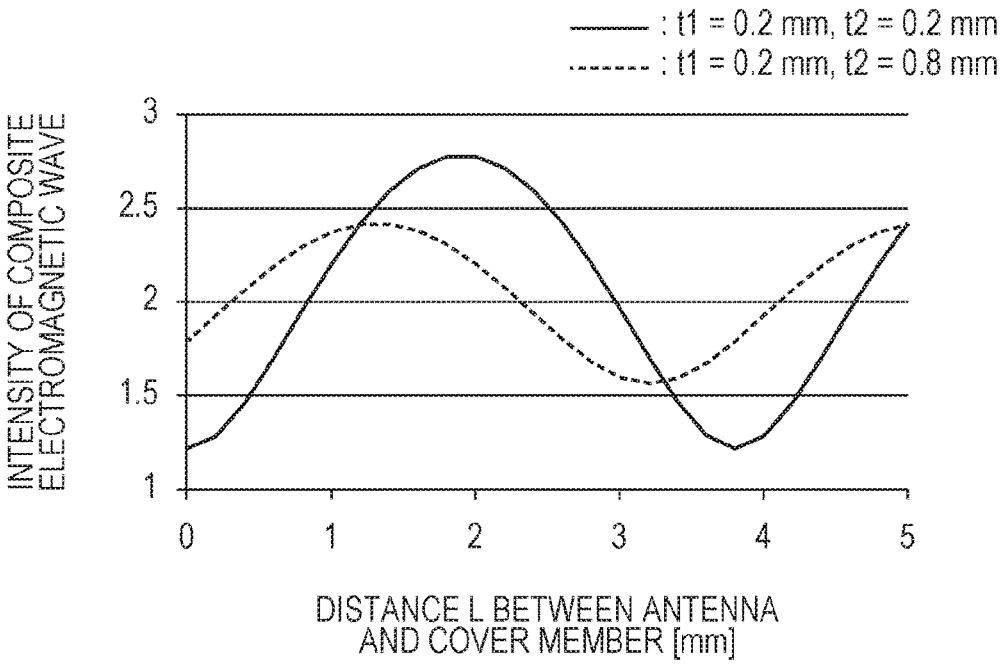
FIG. 4 is a diagram showing changes in intensity of electromagnetic waves.

The following describes the synthesis of a superposed electromagnetic wave from the first antenna 14 and a superposed electromagnetic wave from the second antenna 17. FIG. 4 is a diagram showing the intensity of superposed electromagnetic waves in the case of changes in the distance L (mm), assuming that εc=3, εb=4, and d=3 (mm). In FIG. 4, the vertical axis represents the intensity of superposed electromagnetic waves and the horizontal axis represents the distance L (mm) between the surfaces 12*a* and 15*a* of the antenna elements 12 and 15 and the surface 18*a* of the cover member 18. In FIG. 4, the solid line indicates the intensity of a superposed electromagnetic wave in a case where t1=t2=0.2 (mm) and the broken line indicates the intensity of a superposed electromagnetic wave in a case where t1=0.2 (mm) and t2=0.8 (mm).

In FIG. 4, the intensity of the superposed electromagnetic wave in the case where t1=t2=0.2 (mm) ranges from approximately 1.25 to approximately 2.75. Meanwhile, the intensity of the superposed electromagnetic wave in the case where t1=0.2 (mm) and t2=0.8 (mm) ranges from approximately 1.6 to approximately 2.4.

That is, an arrangement of antennas whose reflection plates take different positions in the Z direction can better reduce variations in the intensity of an electromagnetic wave than does an arrangement of antennas whose reflection plates take the same position in the Z direction.

According to the first embodiment, as described above, the first antenna element 12 and the second antenna element 15 are disposed on the same substrate to take the same position in the Z direction and the first reflecting plate 13 and the second reflecting plate 16 are disposed within the same substrate to take different positions in the Z direction. This makes it possible to reduce the occurrence of multiple reflections of an electromagnetic wave between the antenna device 10 and the cover member 18 and thus reduce variations in detection performance of the radar apparatus.

Second Embodiment

Figure 5:
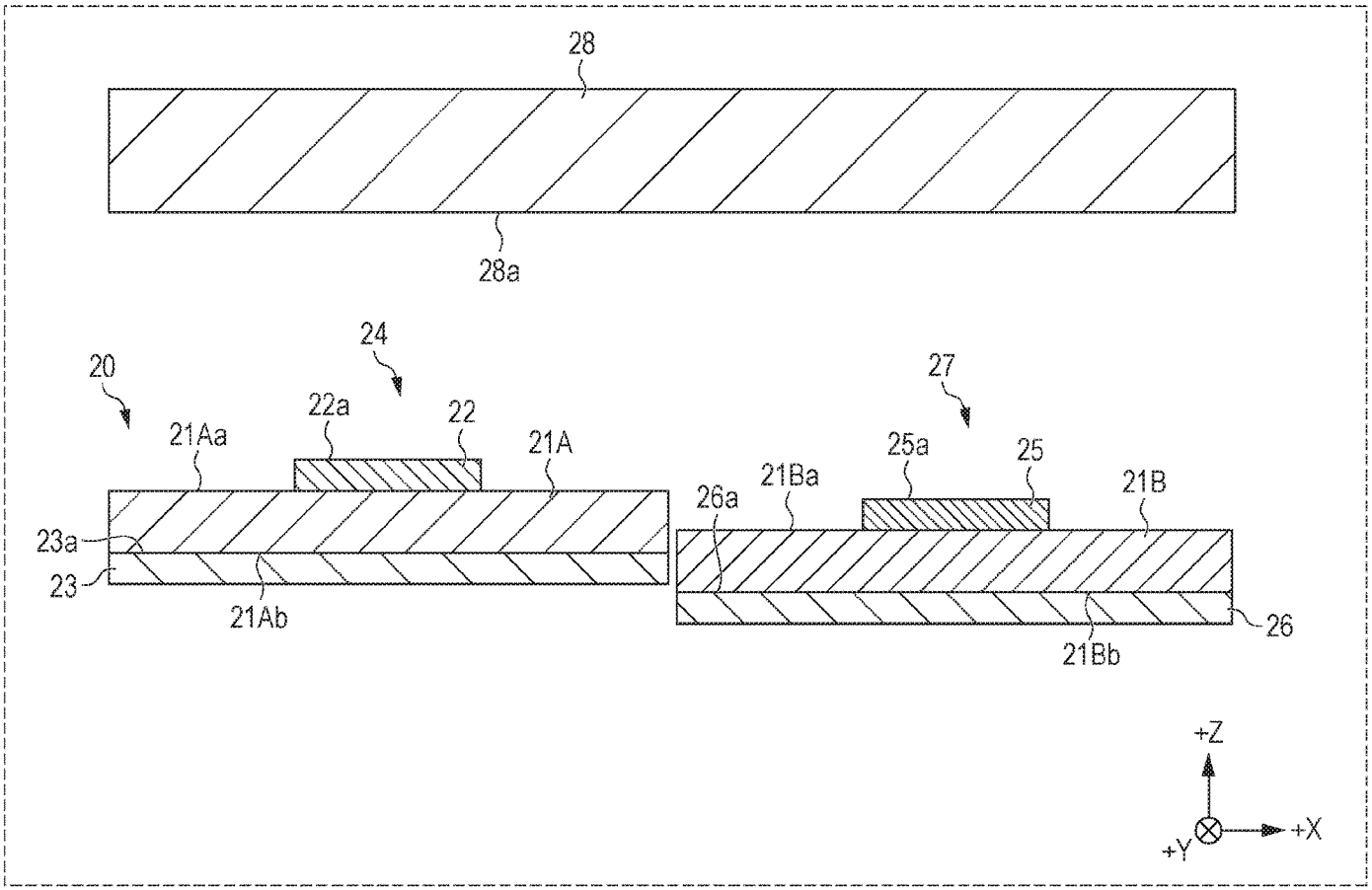
FIG. 5 is a cross-sectional view showing an antenna device according to a second embodiment.

FIG. 5 is a diagram showing a positional relationship between an antenna device 20 according to a second embodiment and a cover member 28.

The antenna device 20 includes a first antenna 24 and a second antenna 27. The first antenna 24 includes a first substrate 21A, a first antenna element 22, and a first reflecting plate 23. The second antenna 27 includes a second substrate 21B, a second antenna element 25, and a second reflecting plate 26. It should be noted that although not illustrated in FIG. 5, a chassis structure for keeping a positional relationship between the first substrate 21A and the second substrate 21B as shown in FIG. 5 is provided. This chassis structure may for example be a metal chassis molded by cutting or casting or a resin chassis molded by cutting or injection molding. In a case where the aforementioned chassis structure is a metal chassis, it is made of a material such as an aluminum compound. In a case where the aforementioned chassis structure is a resin chassis, it is made of a material such as PBT, PPT, or nylon.

In the first antenna 24, the first antenna element 22 is disposed on a surface 21Aa of the first substrate 21A that faces the cover member 28. The first reflecting plate 23 is disposed on a surface 21Ab of the first substrate 21A opposite to the surface 21Aa.

In the second antenna 27, the second antenna element 25 is disposed on a surface 21Ba of the second substrate 21B that faces the cover member 28. The second reflecting plate 26 is disposed on a surface 21Bb of the second substrate 21B opposite to the surface 21Ba.

The second antenna element 25 is identical in shape to the first antenna element 22, and the second antenna element 25 is equal in thickness to the first antenna element 22. Further, the second reflecting plate 26 is identical in shape to the first reflecting plate 23, and the second reflecting plate 26 is equal in thickness to the first reflecting plate 23.

In the antenna device 20, the distance from a surface 22*a* of the first antenna element 22 to a surface 28*a* of the cover member 28 and the distance from a surface 25*a* of the second antenna element 25 to the surface 28*a* of the cover member 28 are different.

Further, in the antenna device 20, the distance from the surface 22*a* of the first antenna element 22 to a surface 23*a* of the first reflecting plate 23 and the distance from the surface 25*a* of the second antenna element 25 to a surface 26*a* of the second reflecting plate 26 are equal.

Therefore, the distance from the surface 23*a* of the first reflecting plate 23 to the surface 28 of the cover member 28 and the distance from the surface 26*a* of the second reflecting plate 26 to the surface 28*a* of the cover member 28 are different. That is, the first antenna 24 and the second antenna 27 are antennas of the same structure, and the first reflecting plate 23 and the second reflecting plate 26 take different positions in the Z direction.

A simulation analysis was conducted to verify that variations in the intensity of an electromagnetic wave can be reduced by arranging the first and second antennas 24 and 27 of the same structure so that their reflecting plates take different positions in the Z direction.

Figure 6:
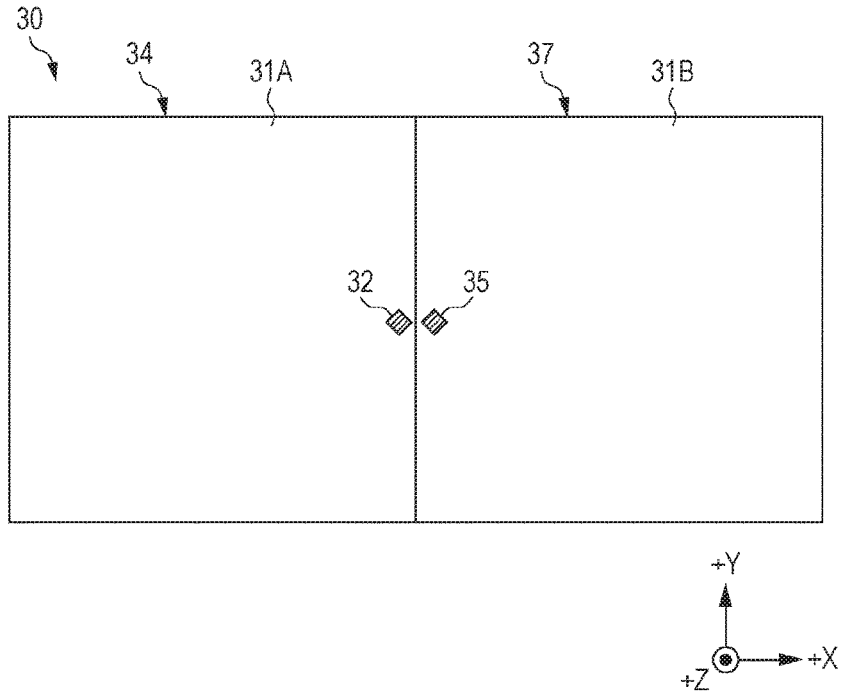
FIG. 6 is a top view of a simulation model.
Figure 7:
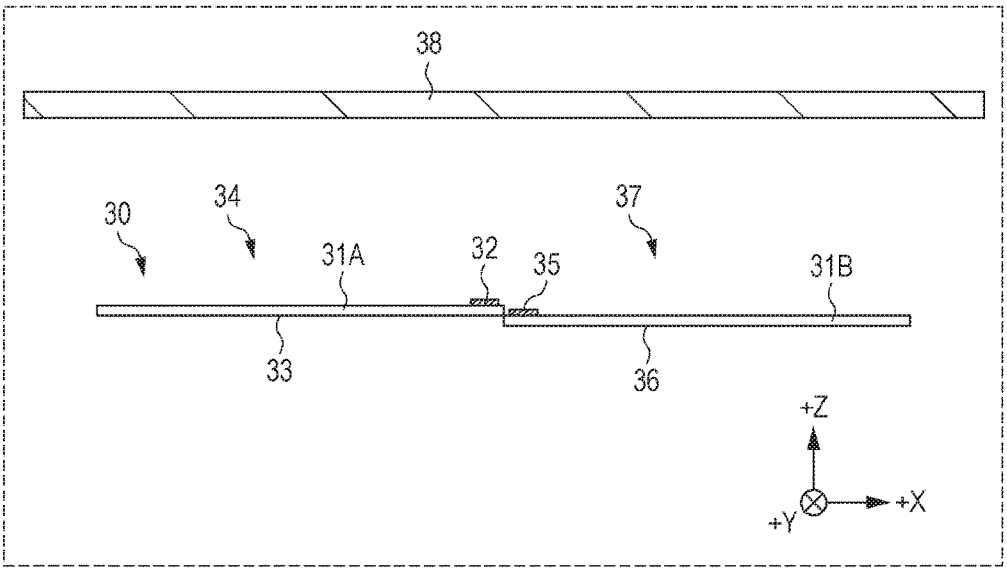
FIG. 7 is a cross-sectional view of the simulation model.

FIG. 6 is a top view of an antenna device model used in the analysis. FIG. 7 is a cross-sectional view of the antenna device model used in the analysis. It should be noted that FIG. 6 omits to illustrate a cover member.

As shown in FIGS. 6 and 7, an antenna device 30 includes a first antenna 34 and a second antenna 37. The first antenna 34 includes a first substrate 31A and a first antenna element 32. The second antenna 37 includes a second substrate 31B and a second antenna element 35. The first substrate 31A and the second substrate 31B are each configured to have an X-direction dimension of 24 mm, a Y-direction dimension of 24 mm, a Z-direction dimension of 0.12 mm, and a relative dielectric constant of 3.

As shown in FIG. 6, the first antenna element 32 is so disposed on a surface of the substrate 31A that faces in the +Z direction as to be located near an edge of the surface in the +X direction and near a central part of the surface in the Y direction. The second antenna element 35 is so disposed on a surface of the substrate 31B that faces in the +Z direction as to be located near an edge of the surface in the −X direction and near a central part of the surface in the Y direction. The first antenna element 32 and the second antenna element 35 are identical in shape and equal in thickness to each other. The first antenna element 32 and the second antenna element 35 are disposed so that their centers coincide in the Y direction.

The antennas used are patch antennas each configured to reach maximum radiation at 79 GHz. Since, as mentioned above, the first substrate 31A and the second substrate 31B are each configured to have a dielectric constant of 3, the wavelength λ of an electromagnetic wave that propagates through the substrate is approximately 2 mm and ¼λ k is approximately 0.5 mm.

As shown in FIG. 7, the substrate 31A is provided with a first reflecting plate 33 completely covering a surface of the substrate 31A that faces in the −Z direction. Further, the substrate 31B is provided with a second reflecting plate 36 completely covering a surface of the substrate 31B that faces in the −Z direction.

As shown in FIG. 7, a cover member 38 is disposed in a position at a first distance from the first substrate 31A in the +Z direction and in a position at a second distance from the second substrate 31B in the +Z direction. The cover member 38 is configured, for example, to have an X-direction dimension of 100 mm, a Y-direction dimension of 100 mm, a Z-direction dimension of 3 mm, and a dielectric constant of 5.

Figure 8:
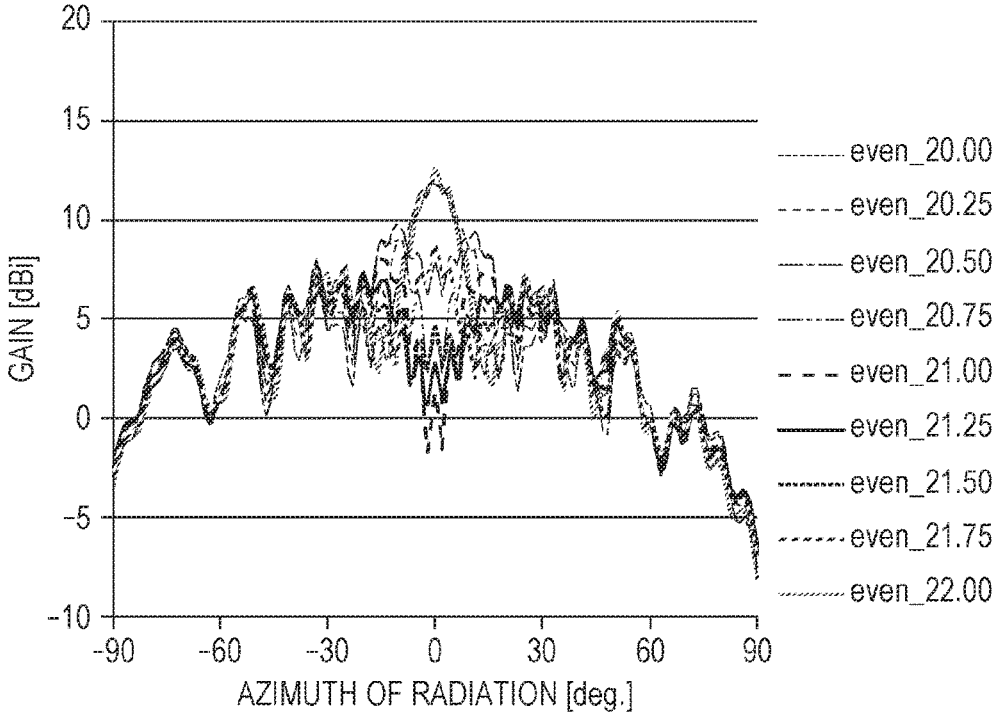
FIG. 8 is a diagram showing simulation results obtained in a case where the distance from a first antenna to the cover member and the distance from a second antenna to the cover member are equal.

FIG. 8 shows the results of an analysis conducted in a case where the first substrate 31A and the second substrate 31B were placed at the same distance from the cover member 38. FIG. 8 shows the resultant values of the radiant gain of the first and second antennas 34 and 37 at various azimuths. In FIG. 8, the vertical axis represents the gain [dBi] and the horizontal axis represents the azimuth of radiation [deg.]. Further, FIG. 8 shows the superimposition of results obtained by changing the distance from the first substrate 31A and the second substrate 31B to the cover member 38 in increments of 0.25 mm from 20 mm to 22 mm.

As shown in FIG. 8, in a case where the first substrate 31A, the second substrate 31B, and the cover member 38 are provided so that the distance from the cover member 38 to the first substrate 31A in the Z direction and the distance from the cover member 38 to the second substrate 31B in the Z direction are equal, changes in the distance from the first substrate 31A and the second substrate 31B to the cover member 38 cause the gain to greatly fluctuate at an azimuth of 0 deg., i.e. in the area near the front. For example, at an azimuth of ±10 deg., the gain fluctuates within a 14 dB range of −2 dBi to +12 dBi.

Figure 9:
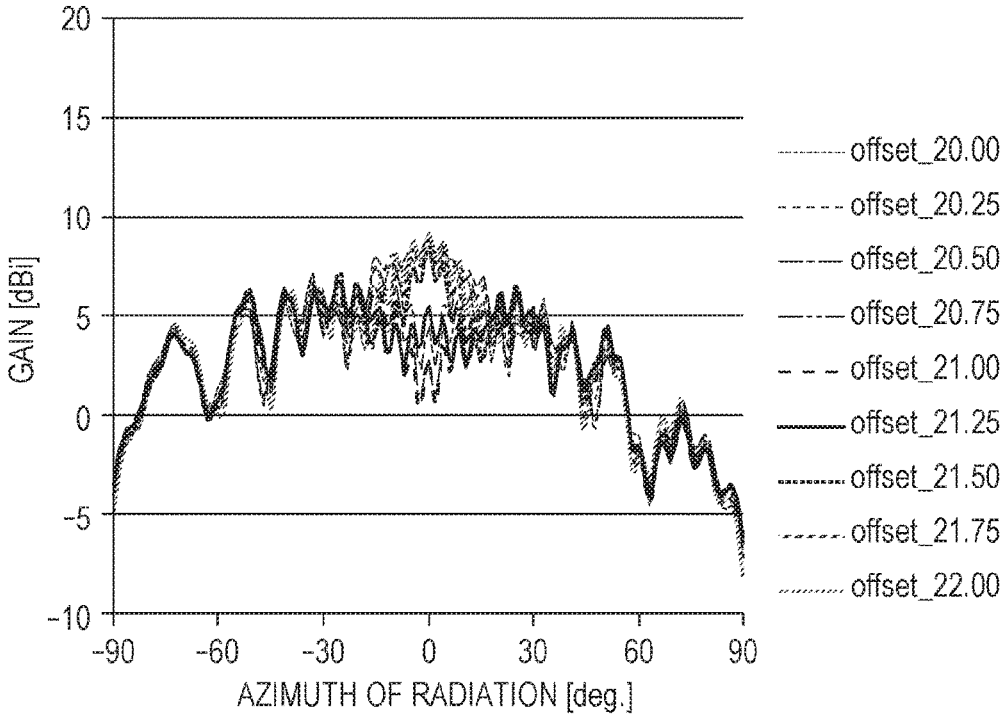
FIG. 9 is a diagram showing simulation results obtained in a case where the distance from the first antenna to the cover member and the distance from the second antenna to the cover member are different.

FIG. 9 shows the results of an analysis conducted in a case where the first substrate 31A was placed at a shorter distance from the cover member 38 by 0.5 mm, which is approximately equivalent to ⅛λ, than the second substrate 31B was. In FIG. 9, the vertical axis represents the gain [dBi] and the horizontal axis represents the azimuth of radiation [deg.]. Further, FIG. 9 shows the superimposition of results obtained by changing the distance from the first substrate 31A to the cover member 38 in increments of 0.25 mm from 20 mm to 22 mm.

As shown in FIG. 9, in a case where the first substrate 31A is placed at a shorter distance from the cover member 38 by 0.5 mm than the second substrate 31B was, changes in the distance from the first substrate 31A and the second substrate 31B to the cover member 38 cause the gain to fluctuate within a 7 dB range of +1 dBi to +8 dBi at an azimuth of ±10 deg. This shows that the range of fluctuation in the gain is kept smaller than in a case where the first substrate 31A and the second substrate 31B are placed at the same distance from the cover member 38.

As described above, the second embodiment includes the first substrate 21A, which is a first portion that is present in a first region, and the second substrate 21B, which is a second portion that is present in a second region, and the first substrate 21A and the second substrate 21B are disposed to take positions displaced from each other in a direction perpendicular to the surface 21Aa of the first substrate 21A and the surface 21Ba of the second substrate 21B.

According to the second embodiment, the first antenna 24 and the second antenna 27 are of the same structure, and the first reflecting plate 23 and the second reflecting plate 26 are disposed to take different positions in the Z direction. This makes it possible to reduce the occurrence of multiple reflections of an electromagnetic wave between the antenna device 20 and the cover member 28 and thus reduce variations in detection performance of the radar apparatus.

Third Embodiment

Figure 10:
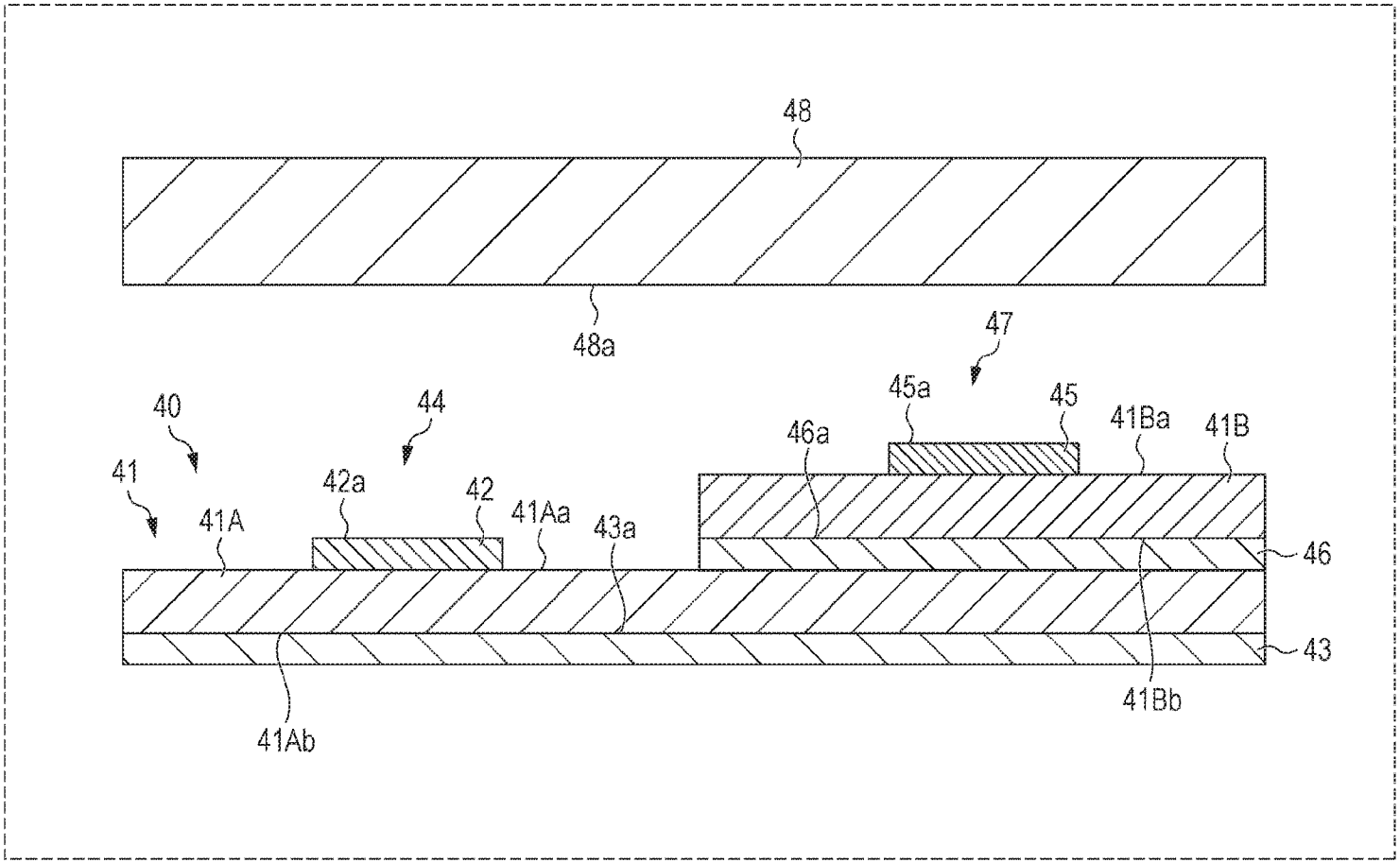
FIG. 10 is a cross-sectional view showing an antenna device according to a third embodiment.

FIG. 10 is a diagram showing a positional relationship between an antenna device 40 according to a third embodiment and a cover member 48.

The antenna device 40 includes a substrate 41, a first antenna 44, and a second antenna 47. The first antenna 44 includes a first substrate portion 41A of the substrate 41, a first antenna element 42, and a first reflecting plate 43. The second antenna 47 includes a second substrate portion 41B of the substrate 41, a second antenna element 45, and a second reflecting plate 46. The substrate 41 includes the first substrate portion 41A and the second substrate portion 41B. In FIG. 10, in a region extending in a direction along the X axis where the first antenna element 42 is provided, the first reflecting plate 43, the first substrate portion 41A, the first antenna element 42, and the cover member 48 are located in this order in a negative to positive direction along the Z axis. In FIG. 10, in a region extending in a direction along the X axis where the second antenna element 45 is provided, the first reflecting plate 43, the first substrate portion 41A, the second reflecting plate 46, the second substrate portion 41B, the second antenna element 45, and the cover member 48 are located in this order in the negative to positive direction along the Z axis.

The substrate 41 is a multilayer substrate in which the thickness of a portion thereof in which the first antenna element 42 is disposed and the thickness of a portion thereof in which the second antenna element 45 is disposed are different. The substrate 41 is fabricated, for example, in the following way.

First, the first reflecting plate 43 is placed entirely on one surface of the first substrate portion 41A. Next, the second reflecting plate 46 is placed entirely on one surface of the second substrate portion 41B, which is smaller in area than the first substrate portion 41A. Finally, the first substrate portion 41A and the second substrate portion 41B are put on top of each other so that a surface of the first substrate portion 41A on which the first reflecting plate 43 is not disposed and the second reflecting plate 46 disposed in the second substrate portion 41B face each other, and then the first substrate portion 41A and the second substrate portion 41B are press molded to form the substrate 41.

In the first antenna 44, the first antenna element 42 is disposed on a surface 41Aa of the first substrate portion 41A that faces the cover member 48. The first reflecting plate 43 is disposed on a surface 41Ab of the first substrate portion 41A opposite to the surface 41Aa.

In the second antenna 47, the second antenna element 45 is disposed on a surface 41Ba of the second substrate portion 41B that faces the cover member 48. The second reflecting plate 46 is disposed on a surface 41Bb of the second substrate portion 41B opposite to the surface 41Ba.

As shown in FIG. 10, the distance from a surface 43*a* of the first reflecting plate 43 to a surface 48*a* of the cover member 48 and the distance from a surface 46*a* of the second reflecting plate 46 to the surface 48*a* of the cover member 48 are different.

Further, the first antenna element 42 and the second antenna element 45 can be connected to the same signal processing IC (not illustrated), for example, by forming through-holes in the substrate 41.

According to the third embodiment, the first antenna element 42 and the second antenna element 45 are disposed on the same substrate to take different positions in the Z direction and the first reflecting plate 43 and the second reflecting plate 46 are disposed within the same substrate to take different positions in the Z direction. This makes it possible to reduce the occurrence of multiple reflections of an electromagnetic wave between the antenna device 40 and the cover member 48 and thus reduce variations in detection performance of the radar apparatus. Further, since it is easy to make an electrical connection between the first substrate portion 41A and the second substrate portion 41B, it becomes possible to feed electricity to each antenna element through the same signal processing IC.

Fourth Embodiment

Figure 11:
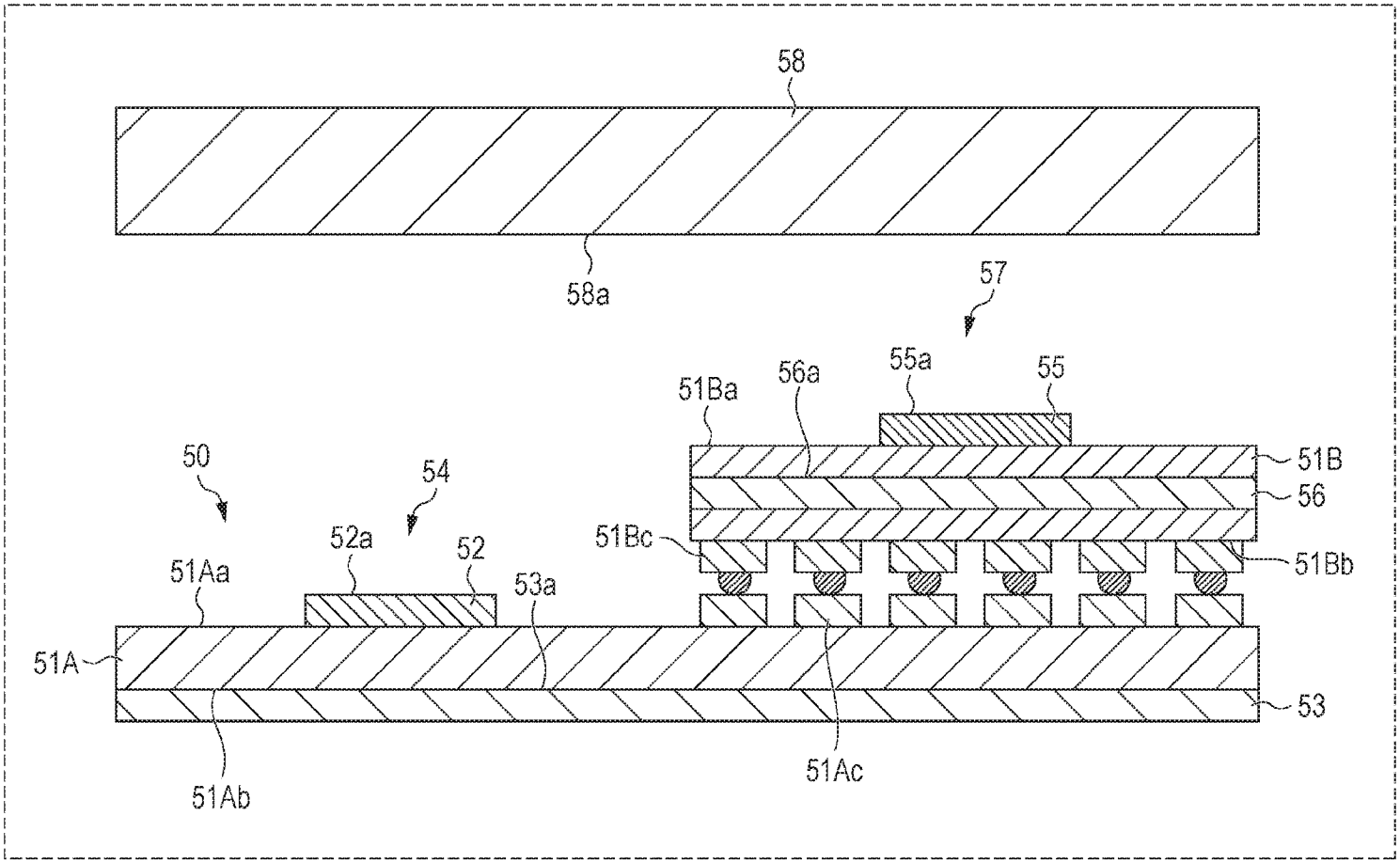
FIG. 11 is a cross-sectional view showing an antenna device according to a fourth embodiment.

FIG. 11 is a diagram showing a positional relationship between an antenna device 50 according to a fourth embodiment and a cover member 58.

The antenna device 50 includes a first antenna 54 and a second antenna 57. The first antenna 54 includes a first substrate 51A, a first antenna element 52, and a first reflecting plate 53. The second antenna 57 includes a second substrate 51B, a second antenna element 55, and a second reflecting plate 56.

In the first antenna 54, the first antenna element 52 is disposed on a surface 51Aa of the first substrate 51A that faces the cover member 58. The first reflecting plate 53 is disposed on a surface 51Ab of the first substrate 51A opposite to the surface 51Aa. Further, the surface 51Aa of the first substrate 51A is provided with a plurality of connectors 51Ac via which the first substrate 51A is connected to the second substrate 51B.

In the second antenna 57, the second antenna element 55 is disposed on a surface 51Ba of the second substrate 51B that faces the cover member 58. The second reflecting plate 56 is disposed within the second substrate 51B. Further, a surface 51Bb of the second substrate 51B opposite to the surface 51Ba is provided with a plurality of connectors 51Bc via which the second substrate 51B is connected to the first substrate 51A.

In the antenna device 50, the second substrate 51B is solder-mounted onto and thereby connected to the first substrate 51A so that the connectors 51Ac of the first substrate 51A and the connectors 51Bc of the second substrate 51B are connected to each other.

According to the fourth embodiment, as with the third embodiment, since it is easy to make an electrical connection between the first substrate 51A and the second substrate 51B, it becomes possible to feed electricity to each antenna element through the same signal processing IC (not illustrated).

Fifth Embodiment

Figure 12:
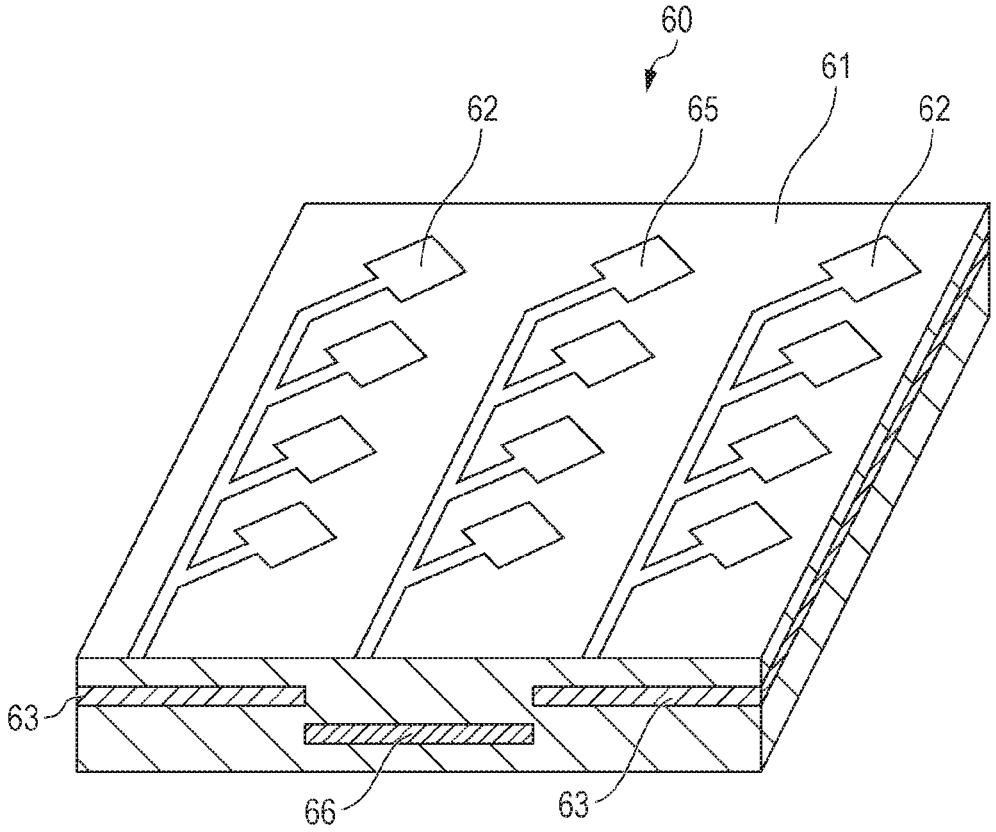
FIG. 12 is a cross-sectional view showing an antenna device according to a fifth embodiment.

FIG. 12 is a diagram showing an antenna device 60 according to a fifth embodiment. The fifth embodiment is an example of application of the present disclosure to a series-feed antenna device. The antenna device 60 includes a substrate 61 and reflecting plates 63 and 66. The substrate 61 has a surface on which antenna arrays 62 and 65 are disposed. The reflecting plates 63 and 66 are placed at different distances from the surface of the substrate 62 for each separate antenna array. The antenna array 62 and the reflecting plate 63 are provided in correspondence with each other, and the antenna array 65 and the reflecting plate 66 are provided in correspondence with each other. It should be noted that FIG. 12 shows an example in which two of these antenna arrays 62 are provided and two of these reflecting plates 63 are provided.

In this way, placing the reflecting plates at different distances from the substrate surface for each separate antenna array also makes it possible to reduce the occurrence of multiple reflections of an electromagnetic wave between the antenna device and a cover member and thus reduce variations in detection performance of the radar apparatus.

Furthermore, placing the reflecting plates at different distances from the substrate surface for each separate antenna array makes it possible to standardize, for each separate antenna array, the impedance of a feed line that is determined by the placement of a signal line and GND, thus making it easy to design a series-feed antenna.

It should be noted that in a case where the antennas used are publicly-known loop antennas, standing-wave antennas, or microstrip antennas, effects can be brought about which are similar to those brought about by the first to fifth embodiments.

The present disclosure can be realized by software, hardware, or software in cooperation with hardware.

Each functional block used in the description of each embodiment described above can be partly or entirely realized by an LSI such as an integrated circuit, and each process described in the each embodiment may be controlled partly or entirely by the same LSI or a combination of LSIs. The LSI may be individually formed as chips, or one chip may be formed so as to include a part or all of the functional blocks. The LSI may include a data input and output coupled thereto. The LSI here may be referred to as an IC, a system LSI, a super LSI, or an ultra LSI depending on a difference in the degree of integration.

However, the technique of implementing an integrated circuit is not limited to the LSI and may be realized by using a dedicated circuit, a general-purpose processor, or a special-purpose processor. In addition, a FPGA (Field Programmable Gate Array) that can be programmed after the manufacture of the LSI or a reconfigurable processor in which the connections and the settings of circuit cells disposed inside the LSI can be reconfigured may be used. The present disclosure can be realized as digital processing or analogue processing.

If future integrated circuit technology replaces LSIs as a result of the advancement of semiconductor technology or other derivative technology, the functional blocks could be integrated using the future integrated circuit technology. Biotechnology can also be applied.

An antenna device according to the present disclosure is applicable to an on-vehicle radar apparatus.

What is claimed is:

1. An antenna device, comprising:

one or more substrates, a first radiating element disposed on a first region of a surface of one or more substrates, a second radiating element disposed on a second region of the surface of the one or more substrates, a first reflecting plate that reflects an electromagnetic wave from the first radiating element, a second reflecting plate that reflects an electromagnetic wave from the second radiating element, and wherein the first reflecting plate and the second reflecting plate take different positions such that they are in different planes and positioned at different positions in relation to the one or more substrates, and the first region and the second region are regions that do not overlap each other on the surface of the one or more substrates, wherein the one or more substrates face a cover covering the antenna device, and wherein:

the one or more substrates include first sub-substrates including the first and second region and second sub-substrates including the second region, the first sub-substrates include the first radiating element and the first reflecting plate, the second sub-substrates include the second radiating element and the second reflecting plate, and the second sub-substrates are disposed on a surface of the first sub-substrates that faces the cover.

2. The antenna device according to claim 1, wherein the second sub-substrates are solder-mounted on the first sub-substrates.

* * * * *